US012392503B2

(12) United States Patent
Rightmier et al.

(10) Patent No.: US 12,392,503 B2
(45) Date of Patent: Aug. 19, 2025

(54) DEDICATED OUTDOOR AIR SYSTEM CONFIGURATION SYSTEMS AND METHODS

(71) Applicant: Johnson Controls Tyco IP Holdings LLP, Milwaukee, WI (US)

(72) Inventors: Earl John Rightmier, Marcy, NY (US); Randi Rae Rizzuto, York, PA (US); Karla Daniela Alvarez Cavazos, Stewartstown, PA (US); Kajal Durga Prasad, Austin, TX (US); Ashish Nandkumar Bardia, Pune (IN)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 70 days.

(21) Appl. No.: 18/463,937

(22) Filed: Sep. 8, 2023

(65) Prior Publication Data

US 2024/0085033 A1 Mar. 14, 2024

Related U.S. Application Data

(60) Provisional application No. 63/404,832, filed on Sep. 8, 2022.

(51) Int. Cl.
*F24F 1/0035* (2019.01)
*F24F 1/0063* (2019.01)

(52) U.S. Cl.
CPC ..... *F24F 1/0035* (2019.02); *F24F 1/0063* (2019.02); *F24F 2221/34* (2013.01)

(58) Field of Classification Search
CPC .... F24F 1/0035; F24F 1/0063; F24F 2221/34; F24F 1/0011
USPC ..... 165/122
See application file for complete search history.

(56) References Cited

U.S. PATENT DOCUMENTS 3,174,541 A * 3/1965 Brandt ..... F24F 13/20 415/214.1
3,678,993 A * 7/1972 Pierce ..... F24F 13/20 165/137
4,478,056 A * 10/1984 Michaels, Jr. ..... F25D 16/00 165/250
6,101,829 A * 8/2000 Robinson ..... F24F 13/20 62/298
8,056,352 B2 * 11/2011 Kang ..... F04D 25/064 62/298
10,473,340 B2 * 11/2019 Tomoigawa ..... F24F 1/0033
(Continued)

*Primary Examiner* — Steve S Tanenbaum
(74) *Attorney, Agent, or Firm* — Fletcher Yoder, PC

(57) ABSTRACT

A direct outdoor air system may include an enclosure having an air inlet to direct environmental air into the enclosure, a heat exchanger section to receive the environmental air and direct conditioned air to an air outlet of the enclosure, and a blower section to receive the environmental air from the air inlet and direct the environmental air to the heat exchanger section via an air flow path between the blower section and the heat exchanger section. The air outlet may direct the conditioned air to a conditioned space. The direct outdoor air system may also include a heat exchanger disposed in the heat exchanger section to condition the environmental air, generating the conditioned air, and a blower disposed in the blower section to motivate the environmental air through the air flow path. Additionally, a heat exchange area of the heat exchanger may be oriented vertically relative to gravity.

20 Claims, 3 Drawing Sheets

(56) References Cited

U.S. PATENT DOCUMENTS

| | | | | |
|---|---|---|---|---|
| 11,079,120 | B2 * | 8/2021 | Zhou | F24F 1/005 |
| 2009/0209193 | A1 * | 8/2009 | Kloster | B60H 1/3204 454/241 |
| 2011/0097988 | A1 * | 4/2011 | Lord | F24F 11/77 454/329 |
| 2020/0309402 | A1 * | 10/2020 | Reardon | F24F 1/03 |

* cited by examiner

DEDICATED OUTDOOR AIR SYSTEM CONFIGURATION SYSTEMS AND METHODS

CROSS-REFERENCE TO RELATED APPLICATIONS

This application claims priority to and the benefit of U.S. Provisional Application No. 63/404,832, entitled "AN HVAC SYSTEM," filed Sep. 8, 2022, which is hereby incorporated by reference in its entirety for all purposes.

BACKGROUND

The present disclosure relates generally to an environmental control system, and, more particularly, a dedicated outdoor air heating, ventilation, and/or conditioning (HVAC) system.

Environmental control systems are utilized in residential, commercial, and industrial environments to control environmental properties, such as temperature and humidity, for occupants of a conditioned space. The environmental control system may control the environmental properties by regulating an air flow delivered to the conditioned space. For example, a dedicated outdoor air system may receive an air flow that originates outside a conditioned space (e.g., building or other structure), condition the air flow, and provide the conditioned air flow to the conditioned space. Furthermore, the dedicated outdoor air system may include one or more heat exchangers to transfer thermal energy to and/or from the air flow. However, the arrangement of the heat exchanger(s) within the dedicated outdoor air system relative to the air may lead to inefficiencies that may be improved.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to direct outdoor air system, which may include an enclosure having an air inlet to direct environmental air into the enclosure, a heat exchanger section to receive the environmental air and direct conditioned air to an air outlet of the enclosure, and a blower section to receive the environmental air from the air inlet and direct the environmental air to the heat exchanger section via an air flow path between the blower section and the heat exchanger section. The air outlet may direct the conditioned air to a conditioned space. The direct outdoor air system may also include a heat exchanger disposed in the heat exchanger section to condition the environmental air, generating the conditioned air, and a blower disposed in the blower section to motivate the environmental air through the air flow path. Additionally, a heat exchange area of the heat exchanger may be oriented vertically relative to gravity.

The present disclosure also relates to a direct outside air system having an enclosure with an air inlet in a side wall of the enclosure and an air outlet in a bottom wall of the enclosure, perpendicular to the side wall. The air inlet may receive an environmental air flow, and the air outlet may direct a conditioned air flow to a conditioned space. The direct outside air system may also include a heat exchanger, disposed in a plane parallel with the side wall, to condition the environmental air flow, generating the conditioned air flow. Additionally, the direct outside air system may also include a blower, disposed within the enclosure, to motivate the environmental air flow from the air inlet to the heat exchanger.

The present disclosure further relates to a direct outside air system that includes an enclosure having an air inlet to direct environmental air into the enclosure in a first direction, a heat exchanger section to receive the environmental air and direct conditioned air to an air outlet out the enclosure, and a blower section to receive the environmental air from the air inlet and direct the environmental air to the heat exchanger section via an air flow path between the blower section and the heat exchanger section. The air outlet may direct the conditioned air to a conditioned space in a second direction, perpendicular to the first direction. The direct outside air system may also include a heat exchanger, disposed in the heat exchanger section, to condition the environmental air, generating the conditioned air, and a blower, disposed in the blower section, to motivate the environmental air through the air flow path. Furthermore, a plane of a heat exchange area of the heat exchanger may be parallel to the second direction.

BRIEF DESCRIPTION OF THE DRAWINGS

Various aspects of this disclosure may be better understood upon reading the following detailed description and upon reference to the drawings in which.

DETAILED DESCRIPTION

Figure 1:
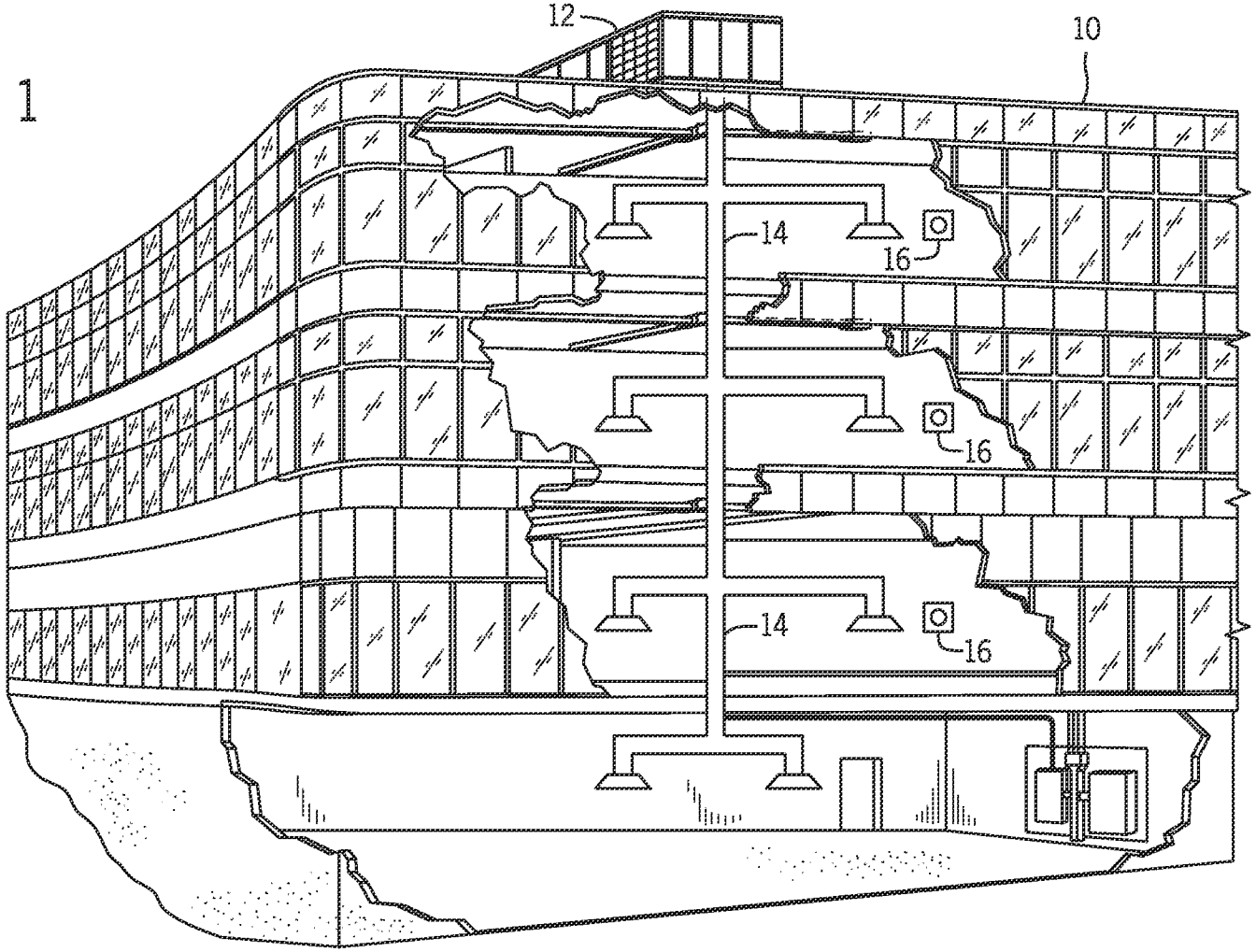
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment"

or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, of the given value or even closer. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

Heating, ventilation, and/or air conditioning (HVAC) systems may be used to thermally regulate a conditioned space within a building, home, or other suitable structure. Furthermore, different types of HVAC systems may be better suited for different implementations, depending on, for example, the characteristics of the conditioned space, conditioning loads, air quality concerns, etc. In particular, a dedicated outdoor air system (DOAS) may receive an air flow from outside the space, condition the air flow, and provide the conditioned air flow to the conditioned space. Contrary to many types of HVAC systems, a DOAS may not utilize a return air flow from the conditioned space, but rather utilize a fresh air flow from the environment, such as outside of the conditioned space.

Furthermore, the DOAS may include one or more heat exchangers to condition the air flow via an exchange of thermal energy between the air flow and the heat exchanger(s). For example, in some embodiments a DOAS includes a heating system having an electric or gas heating coil that heats the air flow. Furthermore, the HVAC system may include a vapor compression system or a heat exchanger thereof that transfers thermal energy between a working fluid, such as a refrigerant, and a fluid to be conditioned, such as the air flow. The vapor compression system includes heat exchangers (e.g. a condenser, an evaporator) that are fluidly coupled to one another via one or more conduits to form a refrigerant circuit. A compressor may be used to circulate the refrigerant through the refrigerant circuit and enable the transfer of thermal energy between components of the vapor compression system (e.g., the condenser, the evaporator) and one or more thermal loads (e.g., the air flow). As should be appreciated, the vapor compression system may be utilized to cool the air flow, such as when operating in an air conditioning mode, or utilized to heat the air flow, such as when operating in a heat pump mode.

Additionally, the DOAS may include one or more fans or blowers that draw air in from the environment, direct the air flow across a heat exchange area of a heat exchanger to enable conditioning (e.g., heating, cooling, dehumidification) of the air, and provide the conditioned air flow to a conditioned space, such as via ductwork. Furthermore, in some embodiments, the DOAS may include a blower section and a heat exchanger section of a housing. However, the arrangement of components of the DOAS, such as an air inlet, blower, heat exchanger, and/or air outlet, in reference to the blower section and heat exchanger sections may affect the air flow efficiency through the housing of the DOAS. For example, in some scenarios, the air inlet may draw the air flow into the blower section horizontally (e.g., relative to an orientation of the DOAS housing) and the air outlet may direct the air flow out of the heat exchanger section vertically (e.g., relative to an orientation of the DOAS housing). Traditionally, in such an arrangement, the heat exchanger may be disposed horizontally within the heat exchanger section, such that the air flow through the heat exchanger is vertical (e.g., parallel with the air outlet). To accommodate the horizontally disposed heat exchanger, a knee wall is disposed between the blower section and the heat exchanger section to prevent or reduce the air flow from circumventing the heat exchanger. However, it is now recognized that the knee wall may reduce the size of the air flow path of the air flow through the DOAS, which may decrease air flow efficiency by increasing a backpressure of the blower section and effecting an increased pressure drop between the blower section and the heat exchanger section. Additionally, it is now recognized that the horizontal orientation of the heat exchanger may increase the horizontal size (e.g., footprint) of the heat exchanger section and, thus, the DOAS.

As discussed further below, in accordance with an embodiment of the present disclosure, a DOAS may include a vertically disposed heat exchanger such that the air flow through the heat exchanger is horizontal relative to the orientation of the DOAS housing. Furthermore, the DOAS may include a blower section and a heat exchanger section without a knee wall therebetween. As such, an air flow efficiency through the DOAS housing may be increased relative to traditional systems. Moreover, by disposing the heat exchanger vertically, a footprint of the DOAS housing may be reduced relative to traditional systems.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components that enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor to detect a climate characteristic or operating parameter, a filter, a control device to regulate operation of an HVAC system component, a component to enable regulation of climate characteristics, or a combination thereof. An "HVAC system" is a system that provides functions such as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12, in accordance with present embodiments. Although the HVAC unit 12 is depicted and discussed herein as being utilized to condition an air flow to a building 10, as should be appreciated, the building 10 is given as an example, and the HVAC unit 12 of the present disclosure may be utilized with any commercial structure, residential structure, temporary structure, vehicle structure (e.g., refrigerated trailer), or any enclosed or partially enclosed space desired to be conditioned. As shown, the HVAC unit 12 is disposed on the roof of the building 10. However, the HVAC unit 12 may be located in other locations such as equipment rooms having fluid access to outside air and/or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, where a second portion of a vapor compression system, such as a condenser unit, is disposed in a separate housing.

Different types of HVAC systems may be better suited for different implementations, depending on, for example, user preferences, the characteristics of the conditioned space, conditioning loads, air quality concerns, etc. As discussed herein, the HVAC unit 12 may be a dedicated outdoor air system (DOAS) that draws fresh air from an environment outside of the building 10, as opposed to a return air flow from within the building 10. Such DOAS HVAC units 12 may be desirable when fresh air is desired to be consistently introduced into the conditioned space, such as to avoid recirculation of air from within the building 10, if return air (e.g., via ductwork 14) is unavailable or unviable, if a positive pressure environment is desired within the building 10, and/or for temporary structures without the infrastructure for a other type HVAC installations. In some embodiments, the DOAS HVAC unit 12 is an air-cooled device that implements a refrigeration cycle to provide conditioned air to the building 10. Specifically, the DOAS HVAC unit 12 may include one or more heat exchangers, across which an air flow is passed to condition the air flow before the air flow is supplied to the building 10. After the DOAS HVAC unit 12 conditions the air flow, the air flow is supplied to the building 10 via ductwork 14, which may extend throughout the building 10 from the DOAS HVAC unit 12. For example, the ductwork 14 may extend to various individual floors or other sections of the building 10. In certain embodiments, the HVAC unit 12 may be a heat pump that provides both heating and cooling to the building with one refrigeration circuit that operates in different modes. In other embodiments, the HVAC unit 12 may include one or more refrigeration circuits for cooling an air stream and/or a furnace for heating the air stream. For example, in some embodiments, the HVAC unit 12 may include an electric heat coil and/or a gas heat coil.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
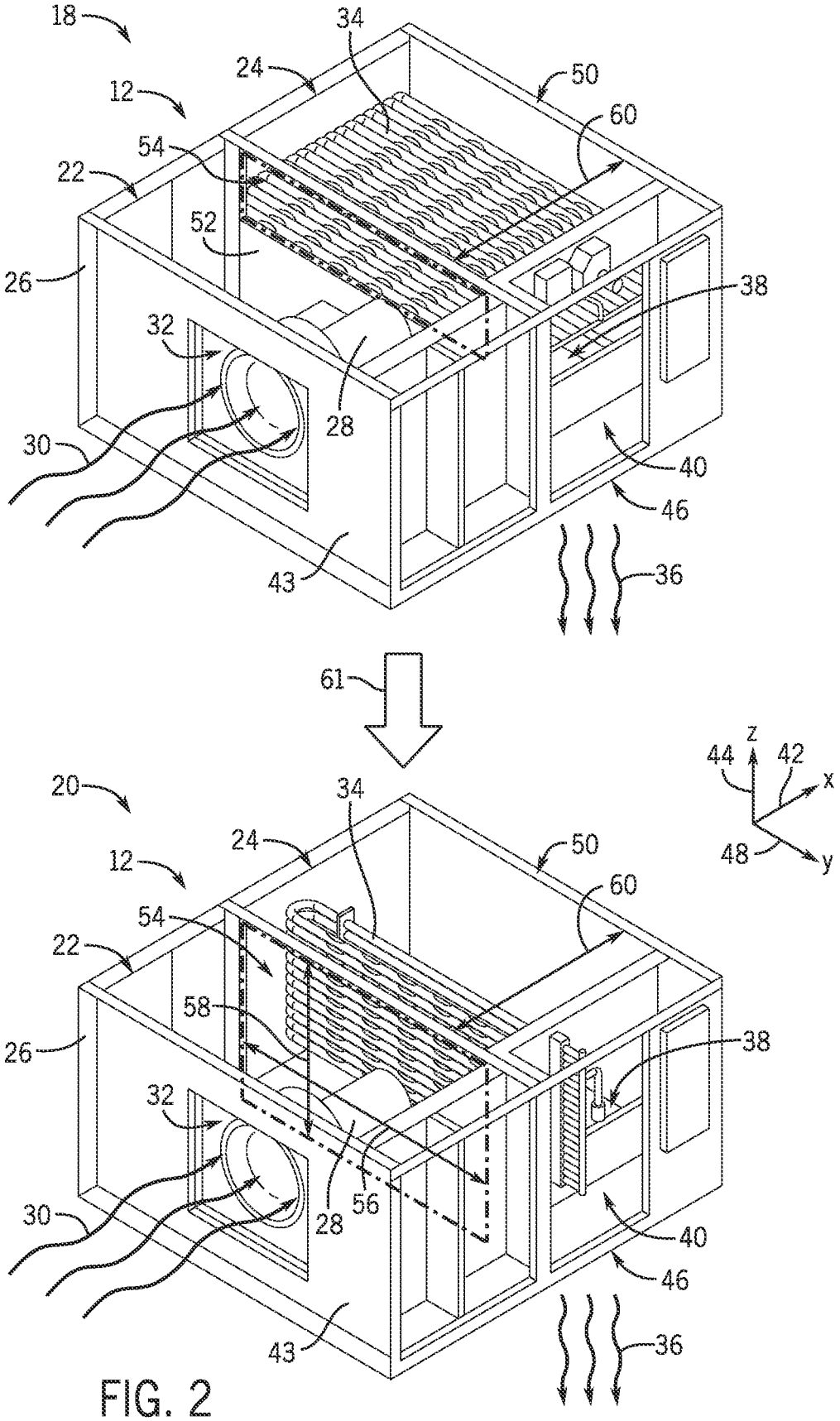
FIG. 2 is a perspective view of two direct outdoor air system HVAC units, illustrating distinctions between a first configuration and a second configuration, in accordance with an aspect of the present disclosure.

As discussed herein, the components of a DOAS HVAC unit 12, may be arranged in different configurations within an enclosure thereof. To help illustrate, FIG. 2 is a perspective view of two DOAS HVAC units 12 illustrating distinctions between a first configuration 18 and a second configuration 20. In the illustrated embodiment, the DOAS HVAC unit 12 includes a blower section 22 and heat exchanger section 24 disposed within and/or forming at least a portion of an enclosure 26. The enclosure 26 may surround the DOAS HVAC unit 12 and provide structural support and protection to the internal components thereof from environmental and other contaminants. In some embodiments, the enclosure 26 may be constructed of galvanized steel and insulated with aluminum foil faced insulation. Moreover, the enclosure 26 may have access panels to allow access for maintenance or installation. The blower section 22 may include one or more fans or blowers 28 that draw an air flow 30 into the blower section 22 through an air inlet 32 (e.g., an opening in the enclosure 26) from the environment, such as outside the building 10 or other structure. Furthermore, the blower 28 may direct the air flow 30 across a heat exchange area of a heat exchanger 34 to enable conditioning (e.g., heating, cooling, dehumidification) of the air flow 30, and provide motivation (e.g., pressure) to direct the conditioned air flow 36 through an air outlet 38 (e.g., an opening in the enclosure 26) to a conditioned space (e.g., building 10), such as via ductwork 14. As used herein, the heat exchange area may be used to describe a planer area of the heat exchanger 34, which may be perpendicular to the general direction of the air flow 30 through the heat exchanger 34.

Figure 3:
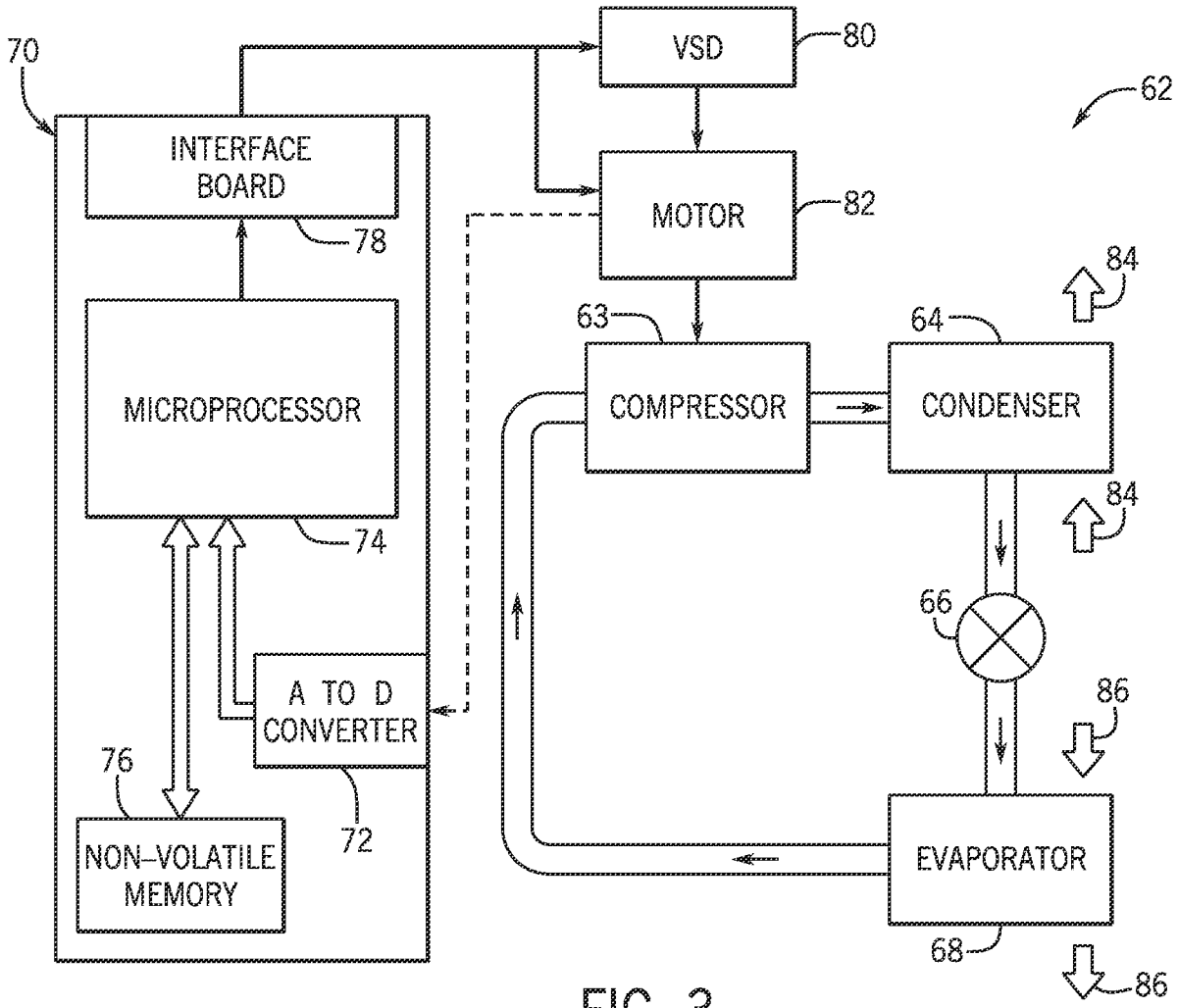
FIG. 3 is a schematic diagram of an embodiment of a vapor compression system used in an HVAC system, in accordance with an aspect of the present disclosure.

The heat exchanger section 24 may include one or more heat exchangers 34 to condition the air flow 30 via an exchange of thermal energy between the air flow 30 and the heat exchanger(s) 34. In some embodiments the DOAS HVAC unit 12 includes a heating system, and the one or more heat exchangers 34 may include an electric heating coil and/or a gas heating coil that heats the air flow 30. For example, an optional additional section 40 of the enclosure 26 may include a combustion chamber to generate a heated gas that passes through the heat exchanger 34 (e.g., as a gas heat coil). Additionally or alternatively, the heat exchanger(s) 34 may include a resistive heat element that produces heat when an electrical current is supplied. Furthermore, as discussed herein, the DOAS HVAC unit 12 system may include a vapor compression system as discussed below with regard to FIG. 3, and the one or more heat exchangers 34 (e.g., condenser or evaporator) may transfer thermal energy between a working fluid, such as a refrigerant, and the air flow. As should be appreciated, the vapor compression system may be utilized to cool the air flow 30, such as when operating in an air conditioning mode, or utilized to heat the air flow 30, such as when operating in a heat pump mode. Moreover, in scenarios where the DOAS HVAC unit 12 includes a vapor compression system, the additional section 40, if implemented, may include a compressor and/or a secondary heat exchanger, such as a condenser or evaporator depending on if the vapor compression system is operated in the heat pump mode or not.

In some configurations, such as the first configuration 18 and the second configuration 20, the air inlet 32 may direct the air flow 30 into the blower section 22 (e.g., motivated by the blower 28) in a horizontal direction (e.g., x-direction 42) through a side wall 43 of the enclosure 26. Additionally, the air outlet 38 may direct the conditioned air flow 36 out of the heat exchanger section 24 in a vertical direction (e.g., z-direction 44 parallel to gravity), such as out a bottom 46 of the enclosure 26. Additionally or alternatively, other air inlets 32 may draw the air flow 30 from the environment from different side walls of the enclosure 26, such as in the y-direction 48, and/or in the vertical direction (e.g., z-direction 44) from a top 50 or bottom 46 of the enclosure 26. Moreover, in some embodiments, the air outlet 38 may direct the conditioned air flow 36 out the top 50 of the enclosure and/or in a horizontal direction (e.g., x-direction 42 and/or y-direction 48).

In the first configuration, the heat exchanger 34 may be disposed horizontally (e.g., in the x-y plane) within the heat exchanger section 24, such that the air flow 30 through the heat exchanger 34 is vertical (e.g., in the z-direction 44) and parallel with the air outlet 38. To accommodate the horizontally disposed heat exchanger 34, a knee wall 52 is disposed between the blower section 22 and the heat exchanger section 24 to prevent or reduce the air flow 30 from circumventing the heat exchanger 34. However, the knee wall 52 may reduce the size of the air flow path 54 between the blower section 22 and the heat exchanger section 24, which may decrease air flow efficiency by increasing a backpressure of the blower section 22 and/or effecting an increased pressure drop between the blower section 22 and the heat exchanger section 24. Additionally, the horizontal orientation of the heat exchanger 34 may increase the horizontal size (e.g., footprint in the x-y plane) of the heat exchanger section 24 and, thus, the DOAS HVAC unit 12.

In the second configuration 20, the heat exchanger 34 is disposed vertically (e.g., in the y-z plane) such that the air flow 30 through the heat exchanger 34 travels horizontally (e.g., in the x-direction 42) relative to the vertical air outlet 38. Furthermore, the DOAS HVAC unit 12 (e.g., in the second configuration 20) may be arranged without a knee wall 52 between the blower section 22 and the heat exchanger section 24. By removing the knee wall 52, the cross section of the air flow path 54 between the blower section 22 and the heat exchanger section 24 may be increased, which may reduce a pressure drop between the blower section 22 and the air outlet 38, increasing air flow efficiency (e.g., blower load vs. volumetric flow rate) and/or the air flow rate. Additionally, in some embodiments, the vertical orientation of the heat exchanger 34 may improve an interaction between the air flow 30 and the heat exchanger 34. For example, instead of making a turn (e.g., 90 degree turn) before crossing the heat exchanger 34, the air flow 30 may be directed directly from the blower section 22 to the heat exchanger 34, which may improve thermal efficiency (e.g., heat transfer efficiency), and the conditioned air flow 36 may make the turn to the air outlet 38 after the heat exchanger 34. As such, by orienting the heat exchanger 34 vertically, such as in-line with the air flow path 54 from the blower section 22 and perpendicular to the air outlet 38, the air flow efficiency and/or thermal efficiency of the DOAS HVAC unit 12 may be increased.

Furthermore, in realizing the increased size of the air flow path 54, in some embodiments, the size of the air flow path 54 between the blower section 22 and the heat exchanger section 24 may be at least the co-planar size of the heat exchanger 34, which may improve air flow efficiency and/or thermal efficiency, as discussed above. Additionally or alternatively, in some embodiments, the size of the air flow path 54 between the blower section 22 and the heat exchanger section 24 may be the entire width 56, greater than 80% of the width 56, or greater than 60% of the width 56 (e.g., in the y-direction 48) and/or the entire height 58, greater than 80% of the height 58, or greater than 60% of the height 58 (e.g., in the z-direction 44) of the blower section 22 and/or the heat exchanger section 24, such as defined by fluid retaining walls of the exterior of the enclosure 26 or internal walls defining fluid retaining chambers of the blower section 22 and/or the heat exchanger section 24. Furthermore, in some embodiments, the air flow path 54 may be inline (e.g., parallel) with the air inlet 32. Moreover, in some embodiments, the heat exchanger 34 may be disposed in a parallel plane with the side wall 43 having the air inlet 32.

Moreover, by disposing the heat exchanger vertically, a footprint of the enclosure 26 may be reduced. For example, a depth 60 (e.g., in the x-direction) of the heat exchanger section 24 may be smaller in the second configuration 20 than in the first configuration 18.

Additionally, in some embodiments, a DOAS HVAC unit 12 in the first configuration 18 may be modified 61 to the second configuration 20 to achieve at least a portion of the benefits of the second configuration 20, such as increased thermal efficiency and/or air flow efficiency. For example, in some embodiments, a DOAS HVAC unit 12 in the first configuration 18 may be modified 61 by removing the heat exchanger 34 and reassembling (e.g., affixing to the enclosure 26) the heat exchanger 34 in the heat exchanger section 24 in a vertical orientation. Moreover, the modification 61 of the DOAS HVAC unit 12 in the first configuration 18 may include removing the knee wall 52. As such, DOAS HVAC unit 12 may be arranged in the second configuration 20 for increased thermal efficiency and/or air flow efficiency.

As discussed above, in some embodiments, the heat exchanger 34 of the DOAS HVAC unit 12 may be part of a heating system. For example, the DOAS HVAC unit 12 may include at least a portion of a furnace system. Such a furnace system may include a burner assembly (e.g., in the additional section 40 or implemented in a separate enclosure) and a heat exchanger (e.g., heat exchanger 34), among other components. Fuel may be provided to the burner assembly of the furnace where it is mixed with air and combusted to form combustion products. The combustion products may pass through tubes or piping of the heat exchanger 34, such that the air flow 30 directed by the blower 28 passes over the tubes or pipes and extracts heat from the combustion products. The conditioned air flow 36 may then be routed from the air outlet 38 to the building 10 or other structure.

Furthermore, as discussed above, such a heating system may supplement or supplant a heat pump mode of a vapor compression system. As should be appreciated, a heating system and vapor compression system may be operated in series or parallel (e.g., having two separate heat exchangers 34) and may be operated simultaneously or separately. To help illustrate, FIG. 4 is a schematic view of a vapor compression system 62 that can be used in any of the systems described herein. The vapor compression system 62 may circulate a refrigerant through a circuit motivated by a compressor 63. The circuit may also include a condenser 64 (e.g., heat exchanger 34), an expansion valve(s) or device(s) 66, and an evaporator 68 (e.g., heat exchanger 34). The vapor compression system 62 may further include a control panel 70 that has an analog to digital (A/D) converter 72, a microprocessor 74, a non-volatile memory 76, and/or an interface board 78. The control panel 70 and its components may function to regulate operation of the vapor compression system 62 based on feedback from an operator (e.g., via control device 16), from sensors (e.g., control device 16) of the vapor compression system 62 that detect operating conditions, and so forth.

In some embodiments, the vapor compression system 62 may use a variable speed drive (VSDs) 80 and/or a motor 82 to drive the compressor 63. The VSD 80 receives alternating current (AC) power having a particular fixed line voltage and fixed line frequency from an AC power source, and provides power having a variable voltage and frequency to the motor 82. In other embodiments, the motor 82 may be powered directly from an AC or direct current (DC) power source. The motor 82 may include any type of electric motor that can be powered by a VSD 80 or directly from an AC or DC power source, such as a switched reluctance motor, an induction motor, an electronically commutated permanent magnet motor, or another suitable motor.

The compressor 63 compresses a refrigerant vapor and delivers the vapor to the condenser 64 through a discharge passage. In some embodiments, the compressor 63 may be a centrifugal compressor. The refrigerant vapor delivered by the compressor 63 to the condenser 64 may transfer heat to a first air stream 84 or other fluid passing across the condenser 64, such as ambient (e.g., outside/environmental) air. The refrigerant vapor may condense to a refrigerant liquid in the condenser 64 as a result of thermal heat transfer with a first air stream 84 (e.g., outside/environmental air). The liquid refrigerant from the condenser 64 may flow through the expansion device 66 to the evaporator 68.

The liquid refrigerant delivered to the evaporator 68 may absorb heat from a second air stream 86, such as the air flow 30, when operated in a cooling mode. For example, the second air stream 86 may include outside air (e.g., air flow 30) drawn into the DOAS HVAC unit 12 via the blower 28. The liquid refrigerant in the evaporator 68 may undergo a phase change from the liquid refrigerant to a refrigerant vapor. In this manner, the evaporator 68 may reduce the temperature of the second air stream 86 via thermal heat transfer with the refrigerant. As discussed above, the vertical orientation of the heat exchanger 34, which may be implemented as an evaporator 68, may provide increased thermal efficiency (e.g., heat transfer efficiency) and/or air flow efficiency through the heat exchanger 34. The vapor refrigerant exits the evaporator 68 and returns to the compressor 63 by a suction line to complete the cycle. Moreover, the cycle may be effectively reversed when operating as a heat pump. As should be appreciated, the heat exchanger 34 of the DOAS HVAC unit 12 may be a part of a condenser 64 and/or evaporator 68 and the roles of each may be reversed depending on implementation (e.g., operating as an air conditioner or heat pump).

As set forth above, embodiments of the present disclosure may provide one or more technical effects useful for efficient configuration of a DOAS HVAC unit 12. Indeed, by orienting a heat exchanger 34 vertically, such that an air flow 30 from a blower section 22 is perpendicular to the vertical plane of the heat exchanger 34 (e.g., despite potentially being parallel to the air outlet 38 requiring a turn of the conditioned air flow 36 after the heat exchanger 34), the size of the air flow path 54 may be increased along with the thermal and/or air flow efficiency of the air flow 30. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A direct outside air system, comprising:

an enclosure comprising:

an air inlet configured to direct environmental air into the enclosure;

a heat exchanger section configured to receive the environmental air and direct conditioned air to an air outlet;

a blower section configured to receive the environmental air and direct the environmental air to the heat exchanger section via an air flow path between the blower section and the heat exchanger section; and the air outlet configured to direct the conditioned air to a conditioned space;

a heat exchanger disposed in the heat exchanger section and configured to condition the environmental air to generate the conditioned air; and a blower disposed in the blower section and configured to motivate the environmental air through the air flow path, wherein a heat exchange area of the heat exchanger is oriented parallel relative to gravity in an installed configuration of the direct outside air system.

2. The direct outside air system of claim 1, wherein the air flow path does not include a knee wall.

3. The direct outside air system of claim 1, wherein the heat exchanger comprises an electrical heating coil.

4. The direct outside air system of claim 1, wherein the heat exchanger comprises a gas heat coil.

5. The direct outside air system of claim 1, wherein the heat exchanger comprises an evaporator of a vapor compression system.

6. The direct outside air system of claim 1, wherein the conditioned air comprises the environmental air does not include a return air from the conditioned space.

7. The direct outside air system of claim 1, wherein the air outlet is configured to direct the conditioned air in a first direction vertically from the enclosure.

8. The direct outside air system of claim 7, wherein the air inlet is configured to direct the environmental air into the enclosure in a second direction perpendicular to the first direction.

9. The direct outside air system of claim 8, wherein a first plane of a cross-section of the air flow path perpendicular to a direction of flow of the environmental air through the air flow path is parallel with a second plane of the heat exchange area of the heat exchanger.

10. The direct outside air system of claim 1, wherein the air flow path comprises a first width and a first height, wherein the first width is at least 80% of a second width of the blower section, and wherein the first height is at least 80% of a second height of the blower section.

11. The direct outside air system of claim 10, wherein the air flow path comprises a cross-sectional area greater than or equal to a size of the heat exchange area of the heat exchanger.

12. A direct outside air system comprising:

an enclosure comprising an air inlet in a side wall of the enclosure and an air outlet in a bottom wall of the enclosure, perpendicular to the side wall, the air inlet configured to receive an environmental air flow, and the air outlet configured to direct a conditioned air flow to a conditioned space;

a heat exchanger disposed in a plane parallel with the side wall and configured to condition the environmental air flow to generate the conditioned air flow; and a blower disposed within the enclosure and configured to motivate the environmental air flow from the air inlet to the heat exchanger.

13. The direct outside air system of claim 12, wherein an air flow path between the blower and the heat exchanger does not include a knee wall.

14. The direct outside air system of claim 13, wherein the air flow path comprises a cross-sectional area greater than or equal to a size of a heat exchange area of the heat exchanger.

15. The direct outside air system of claim 14, wherein the conditioned air flow comprises the environmental air flow and does not include a return air flow from the conditioned space.

16. The direct outside air system of claim 15, wherein the heat exchanger comprises a gas heat coil.

17. A direct outside air system, comprising:

an enclosure comprising:

an air inlet configured to direct environmental air into the enclosure in a first direction;

a heat exchanger section configured to receive the environmental air and direct conditioned air to an air outlet;

a blower section configured to receive the environmental air and direct the environmental air to the heat exchanger section via an air flow path between the blower section and the heat exchanger section; and the air outlet configured to direct the conditioned air to a conditioned space in a second direction, perpendicular to the first direction;

a heat exchanger disposed in the heat exchanger section and configured to condition the environmental air to generate the conditioned air; and a blower disposed in the blower section and configured to motivate the environmental air through the air flow path, wherein a plane of a heat exchange area of the heat exchanger is parallel to the second direction.

18. The direct outside air system of claim 17, wherein the enclosure comprises an additional section comprising a combustion chamber, wherein combusted gases from the combustion chamber are operationally directed through coils of the heat exchanger.

19. The direct outside air system of claim 17, wherein the air flow path comprises a cross-sectional area greater than or equal to 80% of a size of the heat exchange area of the heat exchanger.

20. The direct outside air system of claim 19, wherein the air flow path between the blower and the heat exchanger does not include a knee wall.

* * * * *